US005598867A

United States Patent [19]

Sullivan

[11] Patent Number: 5,598,867

[45] Date of Patent: Feb. 4, 1997

[54] METHOD AND APPARATUS FOR DRAINING PLUMBING LINES

[76] Inventor: George Sullivan, 835 Dundas Street East, Whitby, Ontario, Canada, L1N 2J9

[21] Appl. No.: 373,160

[22] Filed: Jan. 17, 1995

[51] Int. Cl.[6] ..... F16L 55/00; E03B 7/10

[52] U.S. Cl. ..... 137/357; 137/15; 285/7; 285/8; 285/177

[58] Field of Search ..... 137/15, 357; 285/7, 285/8, 177, 176, 169; 15/414, 415.1

[56] References Cited

U.S. PATENT DOCUMENTS

| | | | |
|---|---|---|---|
| 2,189,950 | 2/1940 | Gump | 137/15 |
| 2,673,986 | 4/1954 | Schaefer . | |
| 3,148,895 | 9/1964 | Jasper et al. | 285/8 |
| 3,588,148 | 6/1971 | Barsumian | 285/8 |
| 4,114,230 | 9/1978 | MacFarland . | |
| 4,848,389 | 7/1989 | Pirkle | 137/357 |
| 5,028,077 | 7/1991 | Hurst | 285/8 |
| 5,220,937 | 6/1993 | Roberts et al. | 137/357 |
| 5,382,138 | 1/1995 | Chilton | 417/234 |
| 5,433,246 | 7/1995 | Horton | 137/357 |

FOREIGN PATENT DOCUMENTS

| | | | |
|---|---|---|---|
| 1537833 | 8/1968 | France | 285/177 |

*Primary Examiner*—James Larson
*Attorney, Agent, or Firm*—Bereskin & Parr

[57] ABSTRACT

A vacuum generating device, such as a wet/dry vacuum, is attached to a faucet by an attachment member. The attachment member includes a faucet connector, for connecting to the faucet, and a vacuum connector, for connecting to the vacuum generating device. The faucet connector and vacuum connector are fluidly connected by a conduit. The method for draining plumbing lines includes the step of shutting off the external supply of water to the plumbing lines. The vacuum generating device is then connected to a first faucet, and the valve to the first faucet is opened. The vacuum generating device is then activated and the valves to the remaining faucets are opened in order to create a pressure differential in the plumbing lines. The pressure differential causes water in the lines to flow into the vacuum generating device.

17 Claims, 4 Drawing Sheets

METHOD AND APPARATUS FOR DRAINING PLUMBING LINES

FIELD OF THE INVENTION

The present invention relates to plumbing, and in particular to a method and apparatus for draining lines such as household water pipes.

BACKGROUND OF THE INVENTION

Damaged water pipes is a common problem in areas where houses or cottages remain unoccupied over the cold winter months. Water that sits in the pipes tends to freeze and expand to the point where the pipes become cracked and sometimes burst.

A solution to this problem is provided by draining the water from the water pipes before the house or cottage is closed for the winter. This is typically accomplished by first disconnecting the external supply of water to the building and then opening all faucets in the building to allow gravity to empty the water from the pipes. In many houses however, and in particular in older houses, the pipes have bends and dips that are located along generally horizontal sections where the water settles and does not drain out gravitationally. In such cases, the problem of damaged water pipes remains.

What is needed is a method and apparatus for draining water pipes that sufficiently drains water from all sections of the pipes including any bends and dips located along horizontal sections.

SUMMARY OF THE INVENTION

In one aspect of the present invention there is provided a method for draining water from plumbing lines having an external water supply and a plurality of faucets with valves connected thereto, comprising the following steps:

(a) shutting off the external supply of water to the plumbing lines;

(b) attaching a vacuum generating device to a first one of the plurality of faucets that are connected to said plumbing lines, wherein said vacuum generating device is adapted to collect water through said first faucet;

(c) opening a valve connected to said first faucet to permit air and water flow from said plumbing lines through said first faucet;

(d) actuating said vacuum generating device to establish a pressure drop in said plumbing line at said first faucet;

(e) opening at least one valve connected to at least one other faucet of said plumbing lines to establish a pressure differential in said plumbing lines, said pressure differential causing water located in said plumbing lines to flow towards said first faucet to be collected by the vacuum generating device.

In another aspect, the invention provides an apparatus for draining a plumbing line having a plurality of faucets, comprising:

(a) a vacuum generating device that is adapted to collect water; and (b) an attachment member for sealingly attaching said vacuum generating device to one of said faucets to establish a pressure drop in said plumbing line.

The vacuum generating device (typically a wet/dry vacuum cleaner) provides the advantage of establishing, in a simple and economic way, an increased pressure differential in the plumbing line than would normally be established through conventional gravitational draining methods. The increased pressure differential is typically sufficient to drain a substantial portion of the water that accumulates in the bends and dips located along horizontal sections of the plumbing line.

In another aspect, the invention provides an attachment member for connecting a vacuum generating device to a faucet, comprising:

(a) a conduit having first and second ends;

(b) a faucet connector located at said first end of said conduit for sealingly connecting said conduit to said faucet; and (c) a vacuum connector located at said second end of said conduit for sealingly connecting said conduit to a nozzle located on a hose extending from said vacuum generating device.

The attachment member provides the advantage of allowing conventional vacuum generating devices, such as wet/dry vacuums, to be conveniently and effectively attached to standard household faucets. Furthermore, the simple design of the attachment member allows it to be manufactured at a relatively low cost.

BRIEF DESCRIPTION OF THE DRAWINGS

For a better understanding of the present invention, and to show more clearly how it may be carried into effect, reference will now be made, by way of example, to the accompanying drawings. The drawings show preferred embodiments of the present invention, in which.

DETAILED DESCRIPTION OF PREFERRED EMBODIMENT

Figure 1:
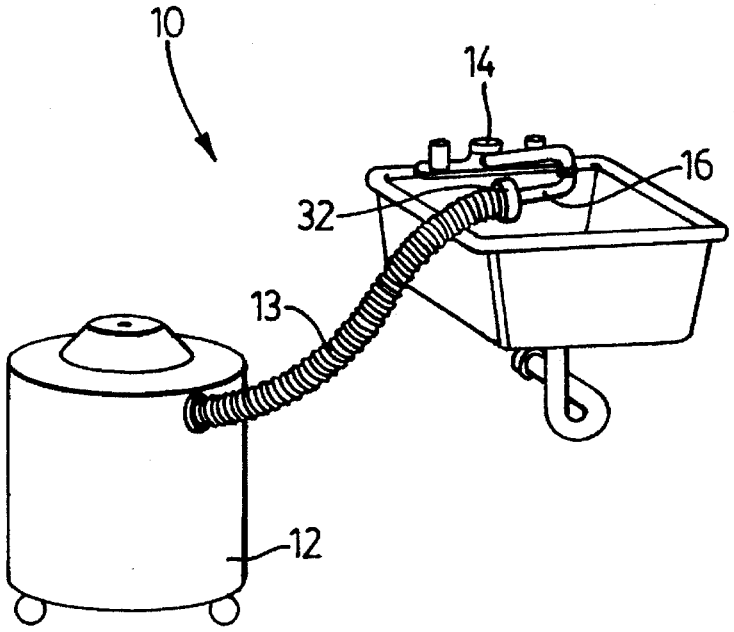
FIG. 1 is a perspective view of a plumbing line draining apparatus in accordance with the present invention, said apparatus being connected to a faucet.

An apparatus for draining plumbing lines in accordance with the present invention is shown generally at 10 in FIG. 1. The apparatus includes a vacuum generating device 12, such as a wet/dry vacuum cleaner, that is adapted to collect the water. The vacuum generating device 12 includes a hose 13 that is connected to a faucet 14 by means of an attachment member 16.

Figure 2:
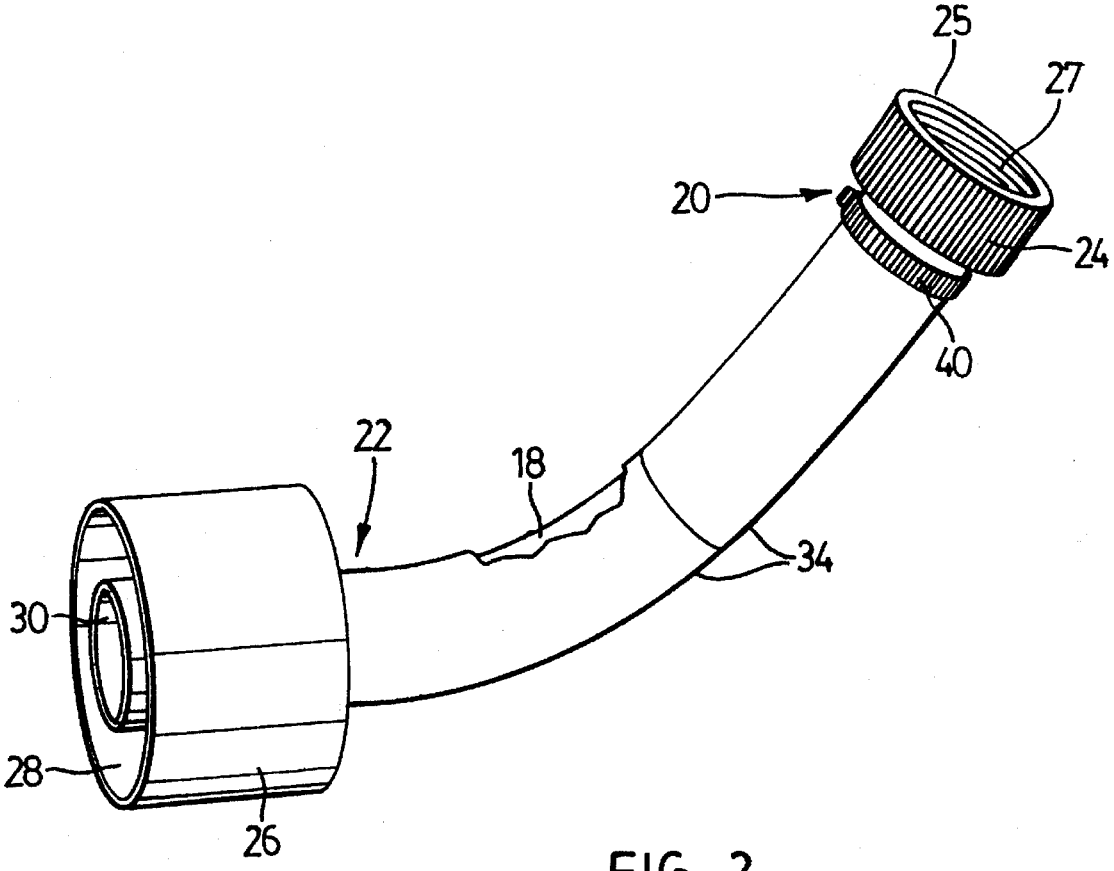
FIG. 2 is a perspective view of an attachment member in accordance with the present invention.
Figure 3:
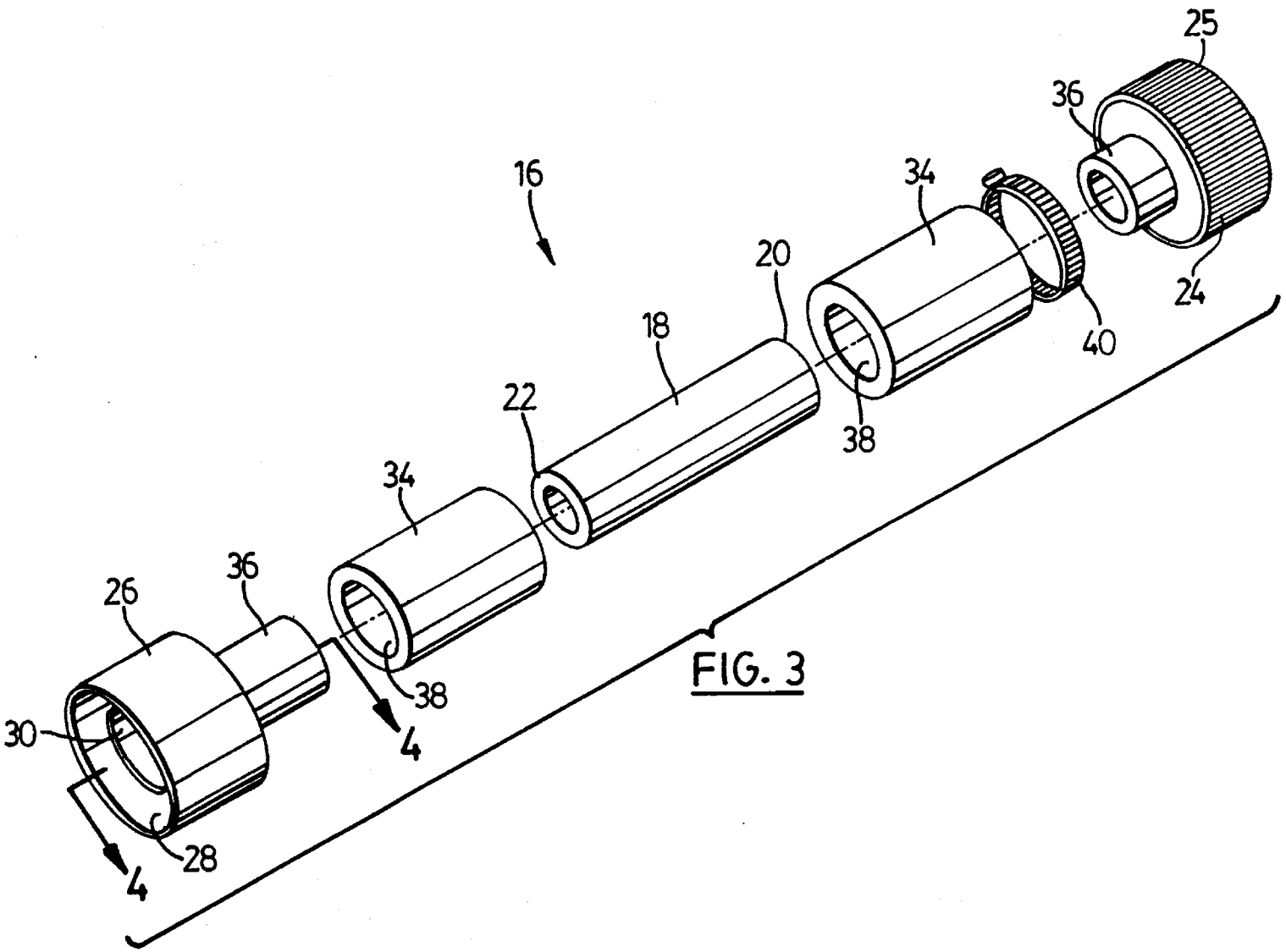
FIG. 3 is an exploded view of the attachment member of FIG. 2.
Figure 4:
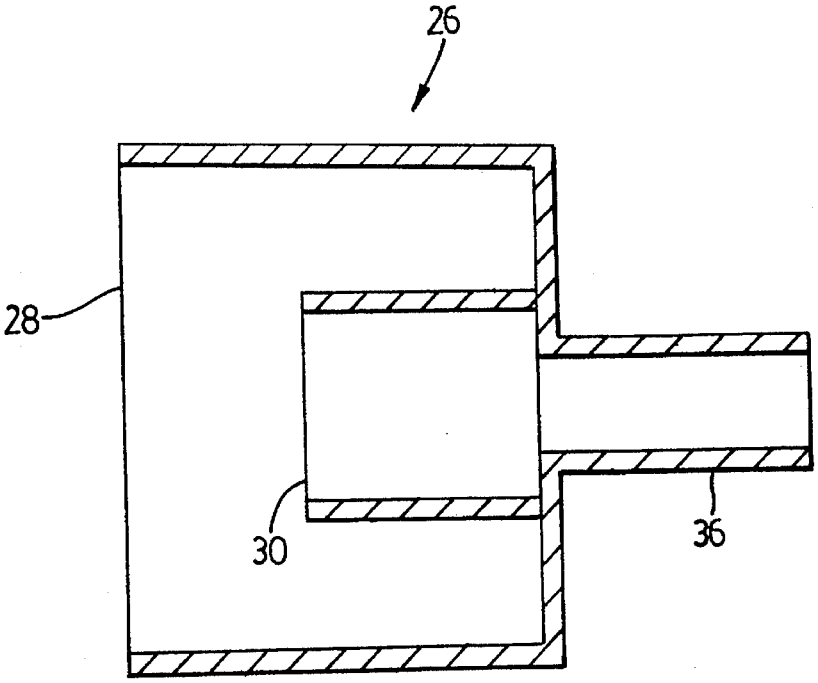
FIG. 4 is a sectional view of the vacuum connector portion of the attachment member of FIG. 3, taken along lines 4—4.
Figure 6:
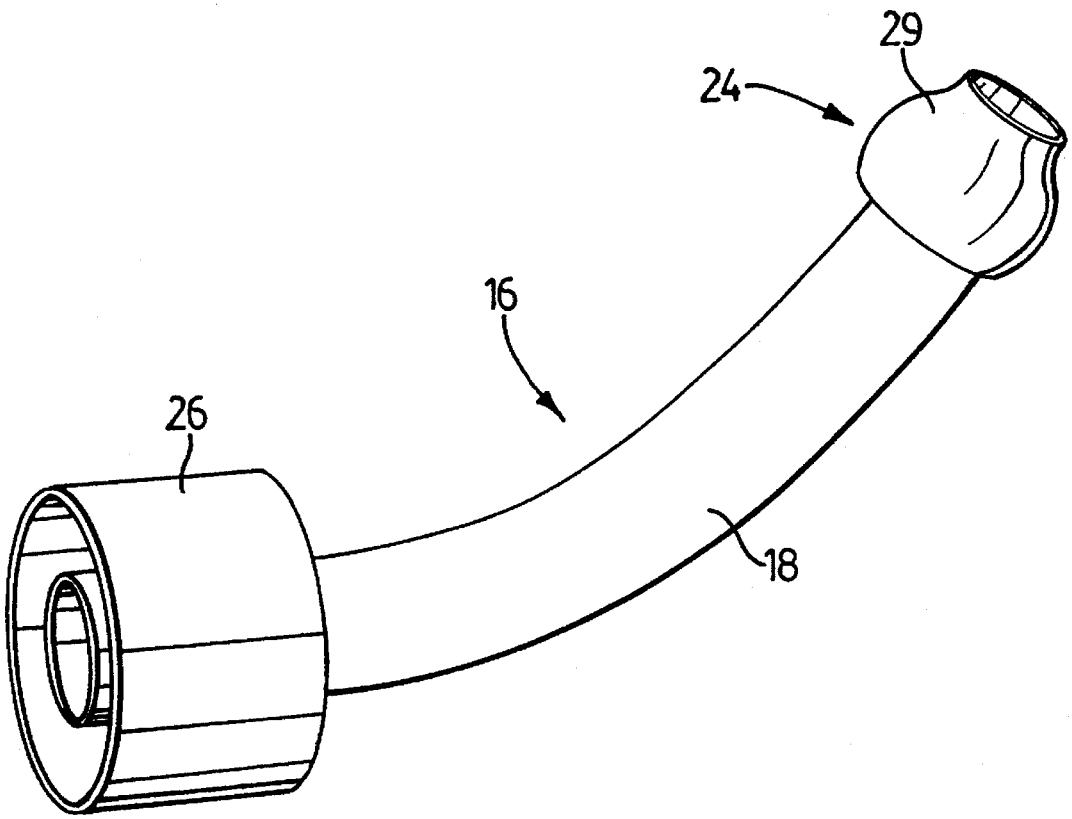
FIG. 6 is a perspective view of a second embodiment of an attachment member in accordance with the present invention.

Referring to FIG. 2 to 4, the attachment member 16 is shown in more detail. The attachment member includes a flexible conduit 18 having first and second ends 20 and 22. A faucet connector 24 is connected to the first end 20 of the conduit 18 for connecting the conduit 18 to a faucet 14. The faucet connector 24 includes a generally cylindrical wall 25 having a female internal thread 27. The internal thread 27 is adapted to threadably engage with a corresponding male thread (not shown) located on the faucet 14. Alternative types of faucet connectors 24 could be used however, such as provided with the second embodiment of attachment member 16 shown in FIG. 6. The second embodiment includes a faucet connector 24 in the form of a rubber sleeve 29 that snugly fits over the faucet to establish a seal. Regardless of the type of faucet connector 24 that is used, it is important that a sufficient seal is provided between the connector 24 and the faucet 14 to permit a vacuum to be established in the plumbing lines, and to permit water to flow through the conduit 18.

A vacuum connector 26 is located at the second end 22 of the conduit 18 for connecting the conduit 18 to the vacuum generating device 12. The vacuum connector 26 includes cylindrical outer and inner walls 28 and 30 that are sized to receive a nozzle 32 extending from the vacuum generating device 12 (the nozzle 32 fitting inside the inner diameter of one of the walls 28, 30 in a friction fit). In the preferred embodiment, the outer wall 28 has an outside diameter of 66 mm and an inside diameter of 58 mm, and the inner wall has an outside diameter of 37 mm and an inside diameter 29 mm. It has been found that the above dimensions are sufficient to accommodate most standard vacuum cleaner nozzles 32. Alternative types of vacuum connector 26 could be used, however, including a connector 26 having a tapered outer wall that is adapted to connect with a nozzle 32 by a friction fit.

Referring to FIGS. 2 and 3, the attachment member 16 of the preferred embodiment includes outer sleeves 34 for attaching the conduit 18 to the faucet connector 24 and the vacuum connector 26. Each connector 24 and 26 includes an attachment collar 36 that is cylindrical and hollow. The outer sleeves 34 have an internal bore 38 that is adapted to receive the conduit 18 and the attachment collars 36 in a friction fit. A hose clamp 40 is fitted over the outer sleeve 34 for clamping the outer sleeve 34 to the faucet connector 24. The hose clamp 40 can be loosened to remove the faucet connector 24 in order that a different type of faucet connector 24 (e.g. one having a flexible sleeve for fitting over the faucet) may be connected to the attachment member 16.

The attachment member 16 described above is constructed from a combination of elements that are commercially available. It will be appreciated that the attachment member 16 could be formed instead as a one piece moulded member where the faucet connector 24 and vacuum device connector 26 are integrally connected to the flexible conduit 18. Such a one-piece moulded attachment member 16 would not require outer sleeves 34 to attach the elements together.

Figure 5:
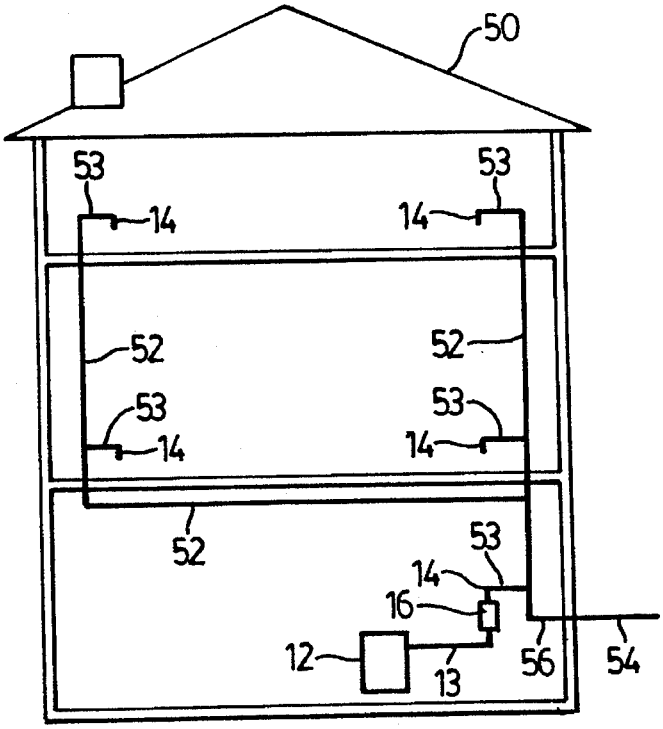
FIG. 5 is a schematic view of a building, showing the steps of the method for draining plumbing lines in accordance with the present invention.

A schematic representation of a building 50 is shown in FIG. 5. The building includes plumbing lines (water pipes) 52 and faucets 14 located in various areas in the building 50. The faucets 14 each include hand operable valves 53 for regulating water or air flow through the faucet 14. The water is supplied to the building through an external supply 54 that includes a valve 56 for regulating the supply to the building.

In order to drain the building's water pipes 52 in accordance with the present invention, the following steps are preferably followed. The valve 56 to the external supply 54 is shut off to prevent water from being introduced to the pipes 52 of the building 50. The vacuum generating device 12 is then connected to a first faucet 14 by means of the attachment member 16. Preferably, the vacuum generating device 12 is connected to the faucet 14 that has the lowest elevation in the building 50. In this way, the pressure differential established in the water pipe 52 will be aided by gravity.

Once the vacuum generating device 12 is properly connected to the first faucet 14, the device 12 is actuated in order to establish a pressure drop in the water pipe 52 at the first faucet 14. The remaining faucets 14 in the building 50 are then opened in order to create a pressure differential in the water pipes 52 that encourages an air and water flow toward the vacuum generating device 12. In this way, water is forced out of the water pipes 52 and into the vacuum generating device 12. It has been found that the increased pressure differential established by the use of a wet/dry vacuum cleaner is sufficient in most houses to drain a sufficient portion of the water in water pipes 52 to avoid damage being caused by freezing.

It is to be understood that what has been described are preferred embodiments of the invention. The invention nonetheless is susceptible to certain changes and alternative embodiments fully comprehended by the spirit of the invention as described above, and the scope of the claims set out below.

I claim:

1. A method for draining water from plumbing lines having an external water supply and a plurality of faucets with valves connected thereto, comprising the steps of:

(a) shutting off the external supply of water to the plumbing lines;

(b) attaching a vacuum generating device to a first one of the plurality of faucets that are connected to said plumbing lines, wherein said vacuum generating device is adapted to collect water through said first faucet;

(c) opening a valve connected to said first faucet to permit air and water flow from said plumbing lines through said first faucet;

(d) actuating said vacuum generating device to establish a pressure drop in said plumbing line at said first faucet;

(e) opening at least one valve connected to at least one other faucet of said plumbing lines to establish a pressure differential in said plumbing lines, said pressure differential causing water located in said plumbing lines to flow towards said first faucet to be collected by the vacuum generating device.

2. A method as claimed in claim 1, wherein said first faucet is located at a lower elevation than said at least one other faucet.

3. A method as claimed in claim 1, wherein said vacuum generating device is a wet/dry vacuum cleaner.

4. An apparatus for draining a plumbing line having a plurality of faucets, comprising:

(a) a vacuum generating device that is adapted to collect water; and (b) an attachment member for sealingly attaching said vacuum generating device to one of said faucets to establish a pressure drop in said plumbing line.

5. An apparatus as claimed in claim 4, wherein said attachment member includes:

(a) a conduit having first and second ends;

(b) a faucet connector located at said first end of said conduit for sealingly connecting said conduit to one of said faucets; and (c) a vacuum connector located at said second end of said conduit for sealingly connecting said conduit to said vacuum generating device.

6. An apparatus as claimed in claim 5, wherein said faucet connector includes a threaded coupling for fitting to a corresponding threaded portion of said faucet.

7. An apparatus as claimed in claim 5, wherein said faucet connector includes a sleeve for fitting over the end of said faucet.

8. An apparatus as claimed in claim 5, wherein said vacuum generating device comprises a wet/dry vacuum cleaner.

9. An attachment member for connecting a vacuum generating device to a faucet, comprising:

(a) a conduit having first and second ends;

(b) a faucet connector located at said first end of said conduit for sealingly connecting said conduit to said faucet; and (c) a vacuum connector located at said second end of said conduit for sealingly connecting said conduit to a nozzle located on a hose extending from said vacuum generating device.

10. An attachment member as claimed in claim 9, wherein said vacuum connector includes outer and inner cylindrical coaxial walls that are adapted to receive two different sizes of said nozzle.

11. An attachment member as claimed in claim 9, wherein said vacuum generating device is a wet/dry vacuum cleaner.

12. An attachment member as claimed in claim 9, wherein said faucet connector includes a threaded coupling for fitting to a corresponding threaded portion of said faucet.

13. An attachment member as claimed in claim 9, wherein said faucet connection includes a sleeve for fitting over the end of said faucet.

14. An attachment member as claimed in claim 9, wherein said conduit is flexible along its length.

15. An attachment member as claimed in claim 9, wherein said conduit, said faucet connector, and said vacuum connector are integrally formed as a one-piece unit.

16. An attachment member as claimed in claim 9, wherein said conduit, said faucet connector, and said vacuum connector are separate pieces, said faucet connector and said vacuum connector each including attachment collars for attaching said connectors to said conduit, and wherein at least one outer sleeve is provided for receiving said conduit and said attachment collars in a friction fit to sealingly attach said separate pieces together.

17. An attachment member as claimed in claim 16, further comprising a hose clamp for clamping said outer sleeve over one of said attachment collars.

* * * * *